US008337257B2

(12) United States Patent
Kaneshiro

(10) Patent No.: US 8,337,257 B2
(45) Date of Patent: Dec. 25, 2012

(54) BUSBAR CIRCUIT STRUCTURE AND TERMINAL BLOCK

(75) Inventor: Daiki Kaneshiro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 108 days.

(21) Appl. No.: 12/952,459

(22) Filed: Nov. 23, 2010

(65) Prior Publication Data

US 2011/0130049 A1 Jun. 2, 2011

(30) Foreign Application Priority Data

Nov. 30, 2009 (JP) ..... 2009-271589

(51) Int. Cl.
*H01R 9/22* (2006.01)

(52) U.S. Cl. ..... 439/709

(58) Field of Classification Search ..... 439/709, 439/700, 213–215, 721–724, 488, 122; 361/601, 361/605, 633, 637
See application file for complete search history.

(56) References Cited

U.S. PATENT DOCUMENTS 6,819,081 B2 * 11/2004 Izawa et al. ..... 320/107
7,830,648 B2 * 11/2010 Strong et al. ..... 361/624
2004/0072474 A1 * 4/2004 Nyblin et al. ..... 439/709

FOREIGN PATENT DOCUMENTS

JP 2005-033882 2/2005

* cited by examiner

*Primary Examiner* — Jean F Duverne
(74) *Attorney, Agent, or Firm* — Gerald E. Hespos; Michael J. Porco

(57) ABSTRACT

A busbar circuit structure has a positive side busbar (30) and a negative side busbar (40) arranged to face each other. Each of the positive side busbar (30) and the negative side busbar (40) has two bolt fastening portions (31, 41) arranged in parallel on a same plane and a coupling portion (32, 42) coupling the bolt fastening portions (31, 41) and extending in a direction intersecting with the same plane. The busbar circuit structure may be mounted to a terminal block housing (20) of a terminal block (10).

12 Claims, 5 Drawing Sheets

BUSBAR CIRCUIT STRUCTURE AND TERMINAL BLOCK

BACKGROUND OF THE INVENTION

1. Field of the Invention

The invention relates to a busbar circuit structure and a terminal block.

2. Description of the Related Art

Japanese Unexamined Patent Publication No. 2005-33882 discloses a busbar circuit structure with a pair of busbars. To achieve miniaturization, an intermediate portion of one busbar is divided and divided ends are bent in the same direction to form tabs. The other busbar is arranged between these divided ends in an insulated manner. The tabs of the one busbar are connected electrically by a complementary busbar. The need to divide and bend the one busbar complicates the processing of the busbar circuit. Further, the need to prepare and connect the complementary busbar as a separate member increases the number of parts. Thus, cost will increase even if the busbar circuit structure can be miniaturized.

The invention was developed in view of the above situation and an object thereof is to miniaturize a busbar circuit structure without increasing cost.

SUMMARY OF THE INVENTION

The invention relates to a busbar circuit structure in which a first busbar and a second busbar are arranged to substantially face each other. Each of the first and second busbars has at least one pair of bolt fastening portions arranged substantially in parallel on a same plane and at least one coupling portion coupling the bolt fastening portions and extending in a direction intersecting the same plane.

The first busbar preferably is a positive side busbar and the second busbar preferably is a negative side busbar.

The arrangement of the coupling portions to intersect the bolt fastening portions enables the busbar circuit structure to be miniaturized more than if the coupling portions and the bolt fastening portions are on the same plane. Further, the coupling portions may be formed by bending, and it is not necessary to divide the bolt fastening portions and the coupling portions. Therefore, the busbar circuit structure can be miniaturized without increasing cost.

The bolt fastening portions of the first and second busbars may be arranged alternately. Accordingly, the first and second bolt fastening portions can be arranged adjacent to each other.

The busbars may be shaped identically. Accordingly, cost can be reduced by using the same structure for both busbars.

The coupling portion of one busbar preferably circumvents the bolt fastening portion of the other busbar. This construction avoids contact of one busbar with terminals or wires connected to the bolt fastening portions of the other busbar.

The side coupling portion may be substantially U-shaped.

The invention also relates to a terminal block with a housing and the above-described busbar circuit structure mounted thereon.

A busbar presser may be provided on the housing to prevent movements of the busbars in directions intersecting mounting directions thereof onto the housing.

The housing may comprise at least two busbar mounting portions into which the busbars are to be mounted.

At least one resiliently deformable locking lance may be provided on the housing for engaging respective locking holes or recesses formed in the respective bolt fastening portions. The resiliently deformable locking lances may be provided on the housing at positions substantially facing the busbar presser in the busbar mounting portions. Thus, the busbar circuit structure can be miniaturized without increasing cost.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
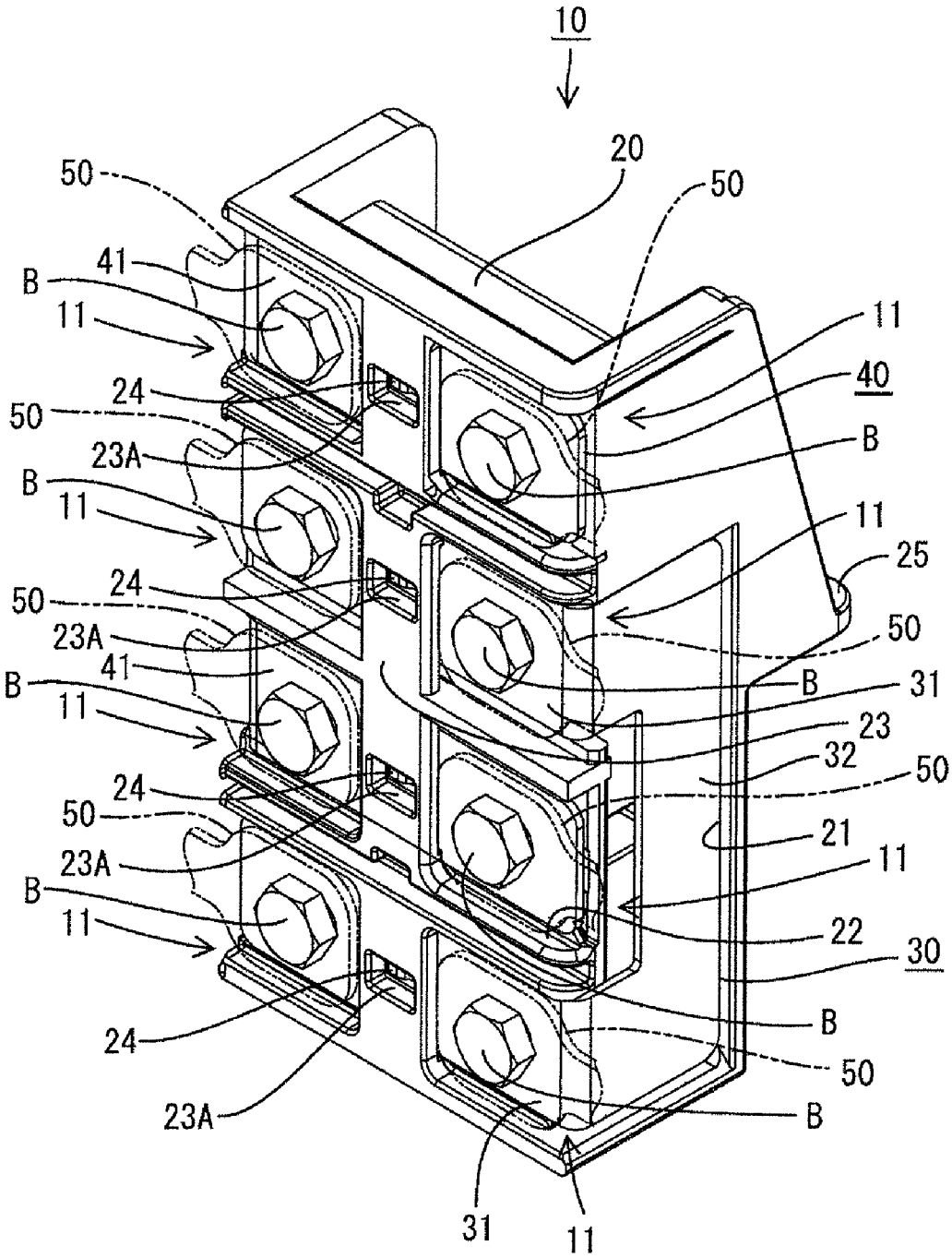
FIG. 1 is a perspective view of a terminal block of one embodiment.
Figure 3:
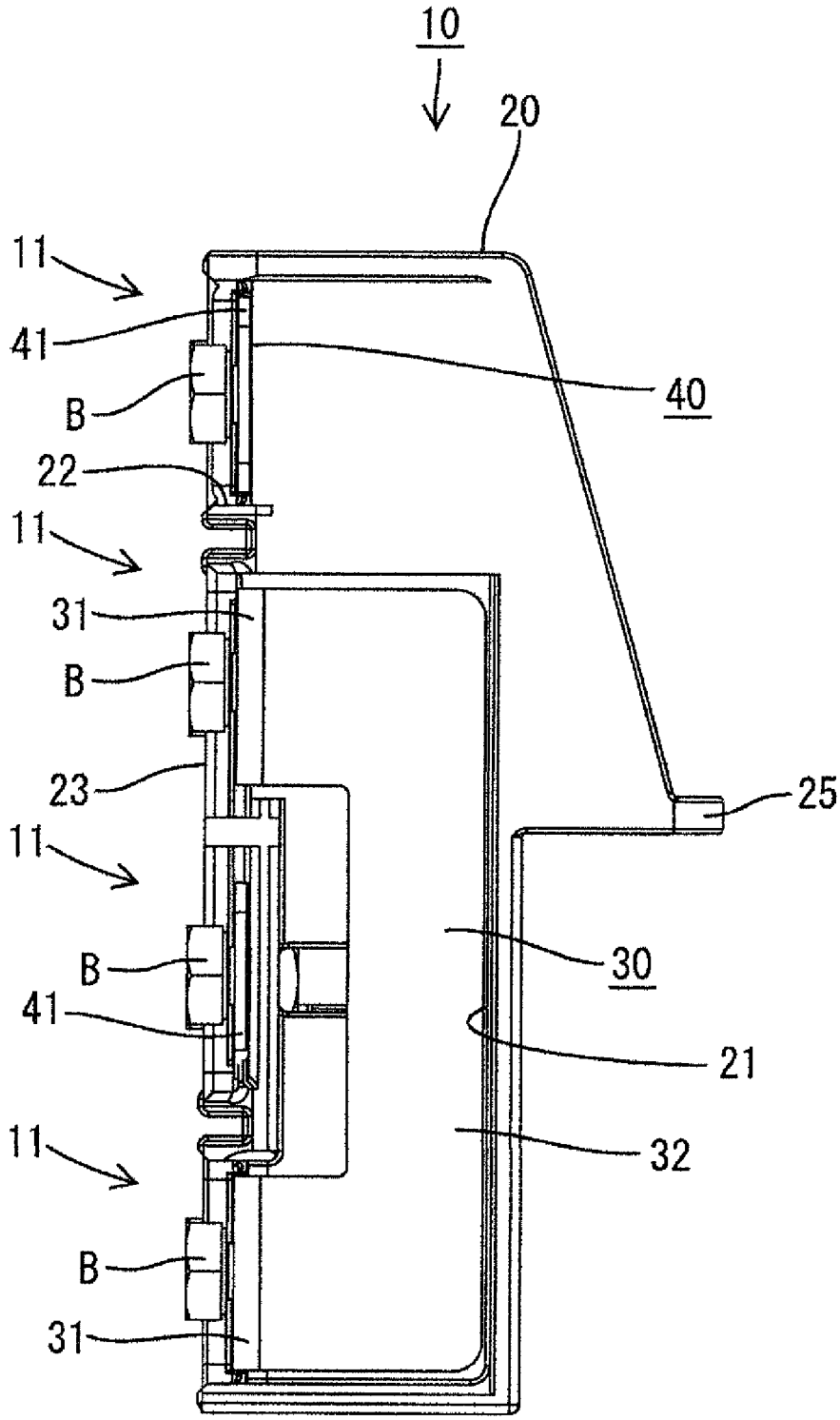
FIG. 3 is a right side view of the terminal block.
Figure 4:
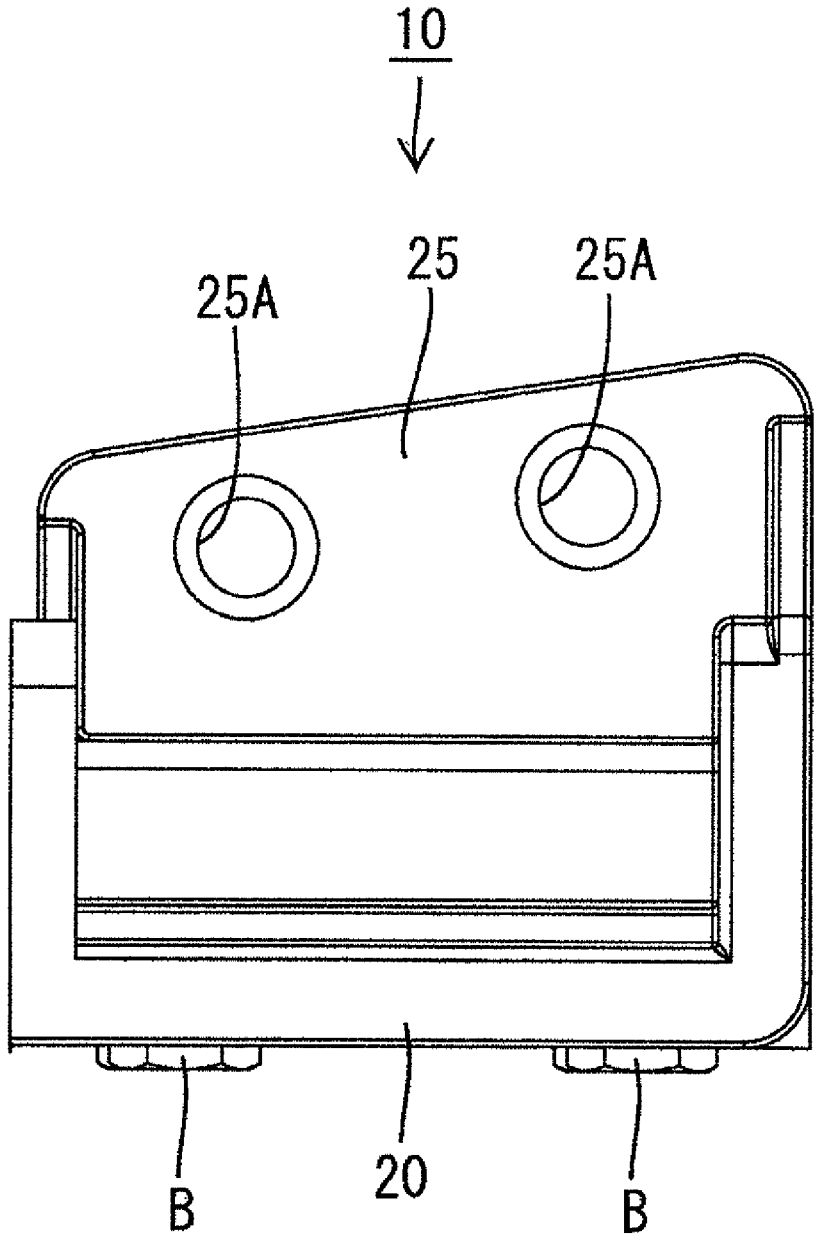
FIG. 4 is a plan view of the terminal block.
Figure 5:
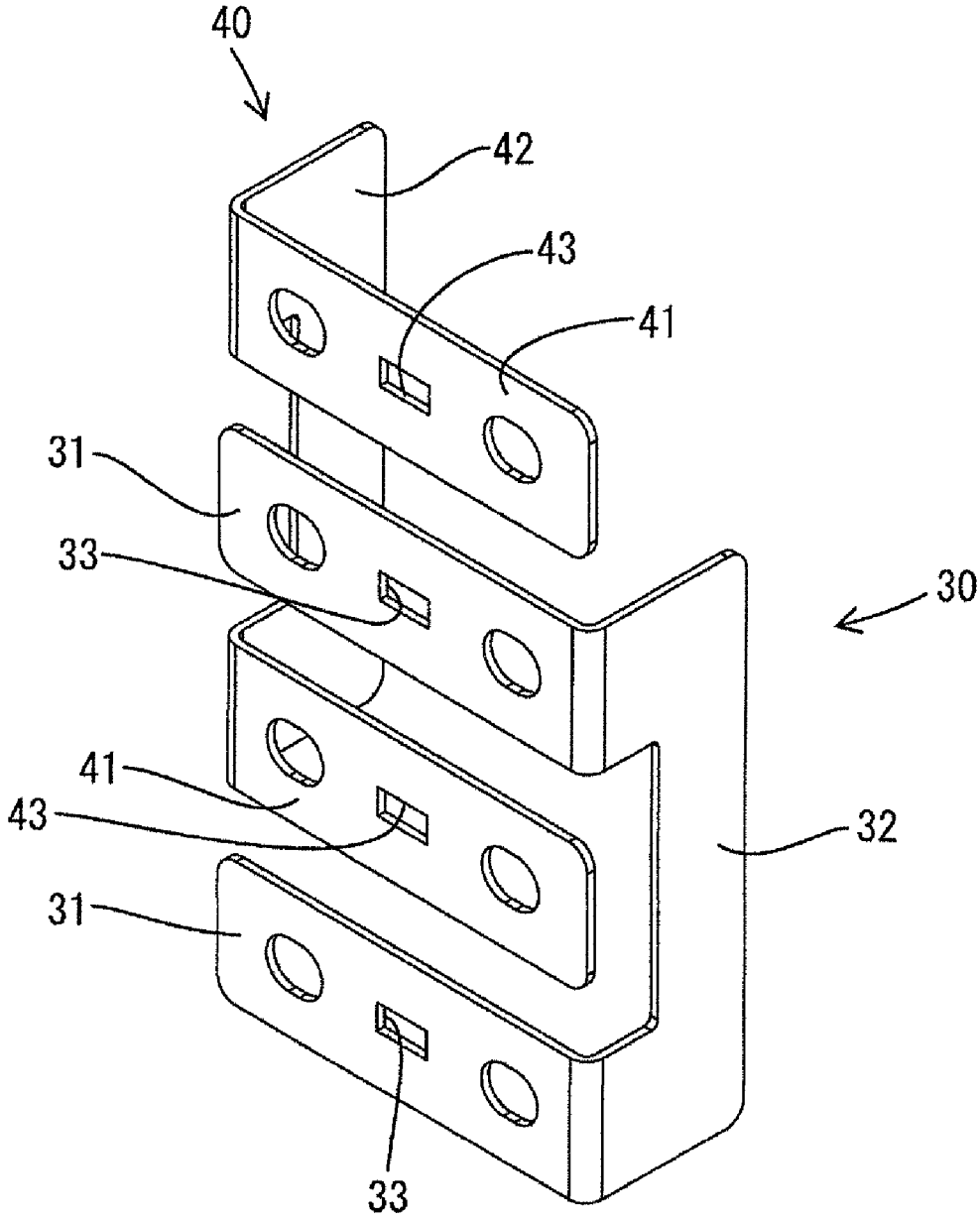
FIG. 5 is a perspective view of a busbar circuit structure.

A terminal block in accordance with the invention is identified by the numeral 10 in FIGS. 1 to 5. The terminal block 10 includes a substantially block-shaped housing 20, as shown in FIG. 1. A first or positive side busbar 30 and a second or negative side busbar 40 are mounted on the terminal block housing 20. As shown in FIG. 5, the busbars 30, 40 are shaped identically and are arranged like comb teeth while substantially facing each other. In the following description, vertical and lateral directions are based on FIG. 2. Since both busbars 30, 40 are identical, the first busbar 30 is described as a representative and corresponding members are denoted by reference numerals with the same unit digits.

Figure 2:
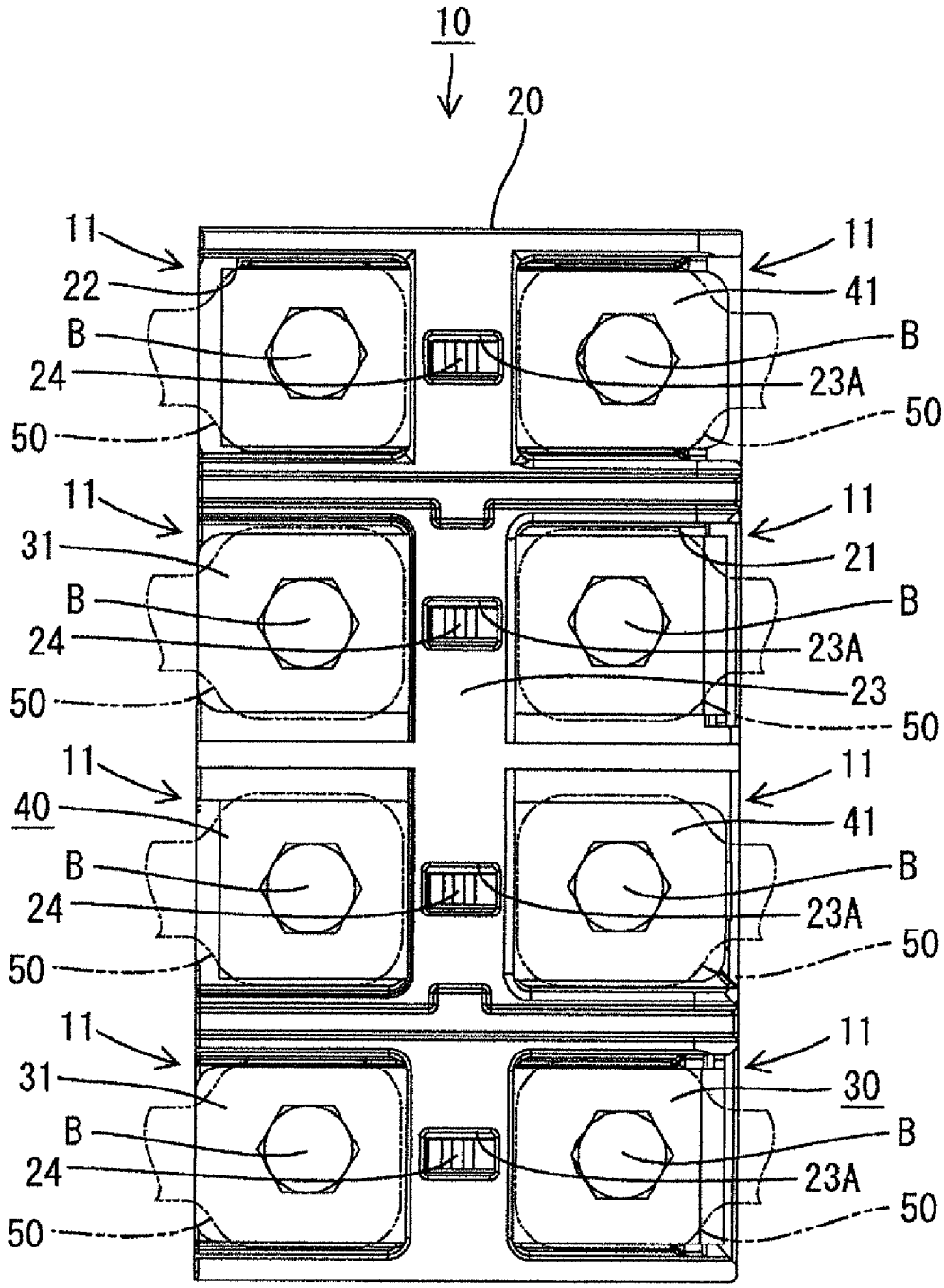
FIG. 2 is a front view of the terminal block.

As shown in FIG. 2, two columns of fastening seats 4 are arranged in the terminal block 10, with each column having four fastening seats 4 vertically arranged one above another. Bolts B are tightened on the respective fastening seats 11, and round terminals 50 are fastened while being sandwiched between heads of the bolts B and the respective busbars 30, 40. Ends of wires (not shown) are to be connected electrically to the respective round terminals 50.

A mounting portion 25 to be mounted on a device (not shown) bulges out from the rear surface of the terminal block housing 20, which, as shown in FIG. 4, is the surface substantially opposite to the surface on which the busbars 30, 40 are arranged. Two mounting holes 25A vertically penetrate the mounting portion 25, and the terminal block 10 is fixed to the device by inserting bolts (not shown) into the mounting holes 25A and bolt-fastening the terminal block 10 to the device.

The first or positive side busbar 30 has two bolt fastening portions 31 arranged in parallel on a fastening surface where the respective fastening seats 11 are arranged and a coupling portion 32 couples the bolt fastening portions 31. The coupling portion 32 extends substantially orthogonal to the fastening surface. Specifically, as shown in FIG. 3, the coupling portion 32 is substantially U-shaped and extends from the fastening surface toward the rear of the terminal block 10 in a manner to circumvent the fastening seat 11 located between the bolt fastening portions 31. In other words, the coupling portion 32 has first portions and a second portion. The first portion is to be arranged on the fastening surface and will contact respective fastening portions 41. The second portion is to be arranged between the first portions and is substantially normal to the fastening surface (e.g. by being arranged on a lateral surface of the housing 20).

The fastening surface of the terminal block housing 20 is smaller than in the case where the bolt fastening portions 31 and the coupling portion 32 are arranged on the same fastening surface. Therefore the terminal block 10 fastening surface can be miniaturized. On the other hand the busbar structure occupies a greater depth on the terminal block housing 20 because the coupling portion 32 extends rearward along the lateral surface of the terminal block housing 20. However, the terminal block housing 20 requires this depth for the nut accommodating recesses (not shown) that receive nuts (not shown) and for the shafts of the bolts B that engage the nuts. Thus, the disposition of the coupling portion 32 on the side surface of the terminal block housing 20 does not increase the depth of the terminal block housing 20.

Two lateral fastening seats 11 are arranged on each bolt fastening portion 31, as shown in FIG. 2. The wire is drawn out laterally from the left fastening seat 11, whereas the wire is drawn out in a substantially opposite direction (e.g. rightward) from the other fastening seat 11. The bolt fastening portions 41 of the negative side busbar 40 and the bolt fastening portions 31 of the positive side busbar 30 are arranged alternately from top on the fastening surface. This arrangement avoids contact of the coupling portion 32 of the positive side busbar 30 with the round terminals 50 that are connected with the lower bolt fastening portion 41 in FIG. 2. Similarly, this avoids contact of the coupling portion 42 of the negative side busbar 40 with the round terminals 50 connected with the upper bolt fastening portion 31 in FIG. 2 or the wires connected to these round terminals 50.

A range extending from the front surface to the right surface of the housing 20 is recessed to form a first or positive side busbar mounting portion 21 in which the positive side busbar 30 is to be mounted. The positive side busbar 30 is mounted into the positive side busbar mounting portion 21 laterally (e.g. from the right side toward the left side) of the housing 20. On the other hand, a range extending from the front surface to the left surface of the terminal block housing 20 is recessed to form a second or negative side busbar mounting portion 22 in which the negative side busbar 40 is to be mounted. The negative side busbar 40 is mounted into the negative side busbar mounting portion 22 laterally (e.g. from the left side toward the right side) of the housing 20.

A busbar presser 23 vertically bridges the both busbar mounting portions 21, 22 and prevents movements of the busbars 30, 40 mounted in the corresponding busbar mounting portions 21, 22 in a rear to front direction orthogonal to mounting directions.

Resiliently deformable locking lances 24 are provided in the busbar mounting portions 21, 22 at positions facing the busbar presser 23. The locking lances 24 are engageable with locking holes 33, 43 that penetrate the respective bolt fastening portions 31, 41 to prevent lateral (e.g. left or right) movement of the busbars 30, 40 mounted in the busbar mounting portions 21, 22.

The locking lances 24 are at positions corresponding to the respective bolt fastening portions 31, 41 and are exposed to the outside through jig insertion openings 23A formed in the busbar presser 23. The jig insertion openings 23A can receive an unlocking jig (not shown) that can cancel a locked state of the respective locking lances 24. The jig insertion openings 23A also function as confirmation windows to confirm the locked state of the locking lances 24 in the respective locking holes 33.

The terminal block 10 is used by mounting the nuts (not shown) into the respective nut accommodating recesses (not shown) of the terminal block housing 20. The busbars 30, 40 are mounted into the corresponding busbar mounting portions 21, 22 after the nuts are mounted and retain the nuts in the respective nut accommodating recesses. The locking lances 24 engage the corresponding locking holes or recesses 33, 43 of the busbars 30, 40 to prevent lateral movements of the busbars 30, 40. Furthermore, the busbar presser 23 prevents forward movements of the busbars 30, 40. In this way, the busbars 30, 40 are held in the corresponding busbar mounting portions 21, 22.

The positive side round terminal 50, which is connected to a battery (not shown), is arranged on the lower left fastening seat 11 in FIG. 2, the negative side round terminal 50 is arranged on the second fastening seat 11 from the bottom on the left side, and the round terminals 50 are bolt-fastened by tightening the bolts B. As a result, the positive side round terminal 50 is connected to the positive side busbar 30 and the negative side round terminal 50 is connected to the negative side busbar 40. Thus, positive side power is supplied to the two upper and lower positive side bolt fastening portions 31, and the two upper and lower negative side bolt fastening portions 41 are connected to a negative side of the battery (or body grounded) via the round terminal 50 connected to the second fastening seat 11 from bottom on the left side.

The terminal block 10 may be used, for example, in a refrigerator truck. In this example, a refrigerator, an inverter, a compressor and the like can be connected to the terminal block 10. In this case, the positive side round terminal 50 of the compressor may be connected to the right lower fastening seat 11 in FIG. 2 and the negative side round terminal 50 may be connected to the second fastening seat 11 from the bottom on the right side. Further, the positive side round terminal 50 of the refrigerator may be connected to the second fastening seat 11 from the top on the right side and the negative side round terminal 50 may be connected to the right upper fastening seat 11. Similarly, the positive side round terminal 50 of the inverter may be connected to the second fastening seat 11 from the top on the left side and the negative side round terminal 50 may be connected to the left upper fastening seat 11. In this way, power form the battery is distributed and supplied to the respective devices via the terminal block 10.

As described above, the coupling portions 32, 42 of the busbars 30, 40 extend substantially orthogonal to the fastening surface. Thus, the busbar circuit structure can be miniaturized more than in the case where the bolt fastening portions 31, 41 and the coupling portions 32, 42 are arranged on the same fastening surface and therefore the terminal block 10 can be miniaturized. Further, both busbars 30, 40 are shaped identically and can be used commonly at a low cost. Further, the positive side coupling portion 32 is substantially U-shaped to circumvent the negative side bolt fastening portion 41 and the negative side coupling portion 42 is substantially U-shaped to circumvent the positive side bolt fastening portion 31. Thus, short-circuiting thereof can be avoided even if the positive side and negative side bolt fastening portions 31 and 41 are arranged adjacent to each.

The invention is not limited to the above described and illustrated embodiment. For example, the following embodiments also are included in the scope of the invention.

Although the positive side bolt fastening portions 31 and the negative side bolt fastening portions 41 are arranged adjacent to each other in the embodiment, the positive side bolt fastening portions 31 may be arranged at the opposite upper and lower sides and the negative side bolt fastening portions 41 may be arranged in a central part according to the invention. In other words, the busbars 30, 40 may be shaped differently.

Although the coupling portions 32, 42 are substantially U-shaped in the above embodiment, they may be shaped without circumventing the bolt fastening portions 31, 41 according to the invention.

Although the present invention is applied to the terminal block 10 in the above embodiment, it may be applied to an electrical connection box.

What is claimed is:

1. A busbar circuit structure, comprising: a first busbar and a second busbar arranged to substantially face each other, each of the first and second busbars including at least two bolt fastening portions disposed so that the bolt fastening portions of the first and second busbars are arranged in a common plane, the busbar circuit structure further comprising a first U-shaped coupling portion extending from sides of the bolt fastening portions of the first busbar farthest from the second busbar and coupling the bolt fastening portions of the first busbar, a second U-shaped coupling portion extending from sides of the bolt fastening portions of the second busbar farthest from the first busbar and coupling the bolt fastening portions of the second busbar and the first and second U-shaped coupling portions extending in a direction intersecting the common plane.

2. The busbar circuit structure of claim 1, wherein the bolt fastening portions of the first busbar are arranged alternately with the bolt fastening portions of the second busbar.

3. The busbar circuit structure of claim 1, wherein the busbars are shaped identically.

4. The busbar circuit structure of claim 1, wherein the coupling portion of at least one of the busbars is arranged to circumvent the bolt fastening portion of the other of the busbars.

5. A terminal block, comprising:

a terminal block housing having a front surface with two first busbar mounting portions and two second busbar mounting portions disposed so that one of the two first busbar mounting portions is between the two second busbar mounting portions and so that one of the two second busbar mounting portions is between the two first busbar mounting portions, the terminal block housing further having first and second side surfaces intersecting the front surface;

a first busbar having two first bolt fastening portions arranged in a common plane and disposed respectively on the two first busbar mounting portions and a first coupling portion coupling the two first bolt fastening portions and disposed on the first side surface of the terminal block housing; and a second busbar having two second bolt fastening portions arranged in a common plane and disposed respectively on the two second busbar mounting portion and a second coupling portion coupling the two second bolt fastening portions and disposed on the second side surface of the terminal block housing, whereby the disposition of the first and second coupling portions respectively on the first and second side surfaces of the terminal block enables the busbars to circumvent one another without dividing either of the busbars.

6. The terminal block of claim 5, wherein the first and second busbars are substantially identical.

7. The terminal block of claim 5, wherein the first and second bolt fastening portions are substantially coplanar.

8. The terminal block of claim 7, wherein the first and second bolt fastening portions are substantially orthogonal to the first and second coupling portions respectively.

9. The terminal block of claim 8, wherein the first and second bolt fastening portions are substantially U-shaped.

10. A terminal block, comprising:

a terminal block housing having a front surface with first and second busbar mounting portions and first and second side surfaces intersecting the front surface;

a first busbar having two first bolt fastening portions arranged in a common plane and disposed on the first busbar mounting portion and a first coupling portion coupling the two first bolt fastening portions and disposed on the first side surface of the terminal block housing;

a second busbar having two second bolt fastening portions arranged in a common plane and disposed on the second busbar mounting portion and a second coupling portion coupling the two second bolt fastening portions and disposed on the second side surface of the terminal block housing; and at least one busbar presser spaced from the busbar mounting portions for preventing movements of the busbars away from the busbar mounting portions in directions intersecting mounting directions of the busbars onto the terminal block housing.

11. The terminal block of claim 10, further comprising resiliently deformable locking lances on the terminal block housing and engageable with locking holes formed in the respective bolt fastening portions.

12. The terminal block of claim 11, wherein the resiliently deformable locking lances are provided on the terminal block housing at positions substantially facing the busbar presser.

* * * * *